United States Patent [19]

Sohn

[11] 4,376,647

[45] Mar. 15, 1983

[54] PROCESS FOR TREATING SULFIDE-BEARING ORES

[75] Inventor: Hong Y. Sohn, Salt Lake City, Utah

[73] Assignee: University of Utah, Salt Lake City, Utah

[21] Appl. No.: 235,177

[22] Filed: Feb. 17, 1981

Related U.S. Application Data

[63] Continuation-in-part of Ser. No. 82,198, Oct. 5, 1979.

[51] Int. Cl.[3] ..... C22B 1/02

[52] U.S. Cl. ..... 75/7; 423/47; 423/53; 423/61; 423/62; 423/110; 423/153; 423/561 R; 423/563; 423/572

[58] Field of Search ..... 75/1 T, 1 R, 3, 6–9, 75/21; 423/47, 53, 61, 110, 62, 69, 89, 99, 153, 154, 561 R, 561 A, 561 B, 571, 572, 657, 563

[56] References Cited

U.S. PATENT DOCUMENTS

| | | | |
|---|---|---|---|
| 1,731,516 | 10/1929 | Bacon | 423/572 |
| 1,763,712 | 6/1930 | Kissock | 423/61 |
| 2,851,349 | 9/1958 | DeJahn | 75/3 |
| 3,214,263 | 10/1965 | O'Connor | 75/3 |
| 3,701,648 | 10/1972 | Ashby et al. | 75/21 |
| 3,714,325 | 1/1973 | Bloom et al. | 423/53 |
| 3,915,689 | 10/1975 | Bartlett et al. | 75/3 |
| 3,932,170 | 1/1976 | Shah | 75/7 |
| 3,993,472 | 11/1976 | Long et al. | 75/6 |
| 4,093,448 | 6/1978 | Eliseeu et al. | 75/3 |

FOREIGN PATENT DOCUMENTS

| | | | |
|---|---|---|---|
| 2421538 | 6/1975 | Fed. Rep. of Germany | 423/657 |
| 2303083 | 10/1976 | France | 75/9 |

OTHER PUBLICATIONS

Bennett, C. O., et al; *Momentum, Heat, and Mass Transfer;* McGraw Hill, New York, N.Y., pp. 202–207 (1962).

*Primary Examiner*—Michael L. Lewis

*Attorney, Agent, or Firm*—H. Ross Workman; Allen R. Jensen; Drew S. Hamilton

[57] ABSTRACT

A process for removing sulfur from sulfide-bearing ores by reacting water vapor with the sulfide-bearing ore forming hydrogen sulfide while simultaneously regenerating water vapor by reacting the hydrogen sulfide with lime. Advantageously, the process occurs in the absence of a net consumption or production of gaseous species so that the process can be carried out in a closed system with respect to the gaseous species. Sulfide-bearing ores which can be treated using the process of this invention include sulfide-bearing ores of molybdenum, zinc, iron, mercury, and copper. Advantageously, the molybdenum oxide so produced from the sulfide-bearing ore of molybdenum can be reacted further with lime and water producing calcium molybdate and hydrogen. The chalcopyrite form of the sulfide-bearing ore of copper produces bornite and magnetite.

12 Claims, 2 Drawing Figures

PROCESS FOR TREATING SULFIDE-BEARING ORESRELATED APPLICATIONS

This application is a continuation-in-part application of my copending application Ser. No. 082,198 filed Oct. 5, 1979.

BACKGROUND

1. Field of the Invention

This invention relates to the treatment of sulfide-bearing ores and, more particularly, to a novel process for removing sulfur from sulfide-bearing ores using lime in a closed system, the process proceeding in the absence of the net consumption of gaseous species and without producing gaseous, sulfur-containing pollutants.

2. The Prior Art

Historically, one of the most commonly used methods of treating sulfide-bearing ores to recover the metal values therefrom has been by conventional roasting processes wherein the ore is oxidized to produce oxides of the metal. The roasting process consumes vast amounts of oxygen and, correspondingly, produces vast quantities of sulfur dioxide, and the like, so that it is a very difficult process to isolate against the escape of gaseous, sulfur-containing pollutants. Also, while certain quantities of sulfur-bearing gases can be used for producing sulfuric acid, the acid process is known to convert less than all the gaseous sulfur compounds to sulfuric acid with a corresponding discharge or escape of gaseous sulfur residues to the atmosphere. Additionally, only limited quantities of sulfuric acid can be used in other process industries so that unlimited production of sulfuric acid is not an economically appealing prospect. In view of the increasingly stringent restrictions against the emission of sulfur-bearing pollutants, the resulting expenses involved in obtaining metal oxides from sulfide-bearing ores by conventional roasting process is becoming very high.

Researchers have proposed the use of lime (calcium oxide) to remove the sulfur dioxide produced during the roasting of copper sulfide concentrates. While the chemistry of this known process is rather complex and will not be detailed herein, the major reactions are the reaction between oxygen and, for example, chalcopyrite, which produces sulfur dioxide and the oxides of copper and iron. The sulfur dioxide reacts with lime and oxygen to form calcium sulfate. When using hydrated lime, there is an initial, small amount of water vapor released during the early stages of the process, but this water vapor is rapidly dissipated to the ambient. This process also requires that the sulfide-bearing ore and the lime be placed in close proximity in order for the lime to effectively scavenge the sulfur dioxide.

Problems are also encountered in removing relatively large quantities of thermal energy generated by the reaction inside the bulk of the mixture. Importantly, excessive temperatures can cause sintering of the mixture with resultant complications for further processing. High temperatures also promote the formation of copper ferrite ($CuO.Fe_2O_3$) which is difficult to leach. Others have proposed that this problem can be circumvented by pelletizing the mixture so that the reaction can be controlled by the diffusion of oxygen into the pellet. Although pelletizing provides improvements in temperature control along with sulfur retention, the overall reaction is much slower because of the relatively long diffusion distances. It has been found that a substantial quantity of sulfate is formed during the process and can be undesirable depending upon the type of subsequent treatment required to obtain the desired final product. However, where copper is involved as the final product, this latter consideration is of little consequence.

One similar process is disclosed in U.S. Pat. No. 3,915,689 issued Oct. 28, 1975. This patent relates to a process wherein a copper-sulfide mineral is pelletized with lime and roasted at low temperatures. The resulting sulfur dioxide reacts with the lime to form anhydride ($CaSO_4$).

Other researchers have studied the direct reduction of metal sulfides with hydrogen while using lime to scavenge any hydrogen sulfide generated. The general chemistry of the reaction can be expressed as follows:

$$Me_xS+H_2=xMe+H_2S \quad (1)$$

$$H_2S+CaO=H_2O+CaS \quad (2)$$

so that the overall reaction can be expressed as follows:

$$Me_xS+H_2+CaO=xMe+CaS+H_2O \quad (3)$$

In each of the foregoing chemical equations the term (Me) is used to designate the metal in the respective compound.

One researcher has used lime in the reduction of molybdenite with hydrogen. Others have prepared metallic filaments of the metals, copper, nickel, cobalt, and iron, by reducing the corresponding metal sulfide with hydrogen in the presence of lime. Studies have also been conducted on the reduction of the sulfides of copper and copper/iron using hydrogen. Most of these studies were concerned with improving the unfavorable thermodynamics of the reaction between the metal sulfides and hydrogen (Equation (1), above) by providing lime as a scavenger but were not primarily concerned with the degree of removal of hydrogen sulfide from the product gas.

One researcher has observed a heavy evolution of hydrogen sulfide during the hydrogen reduction of molybdenite in mixture with lime while others reported that the gaseous reaction product was exclusively water. Recently, other researchers have proposed a process concept for producing copper fom chalcopyrite by applying the foregoing reaction scheme.

Clearly, the degree of hydrogen sulfide removal will depend upon the equilibrium concentrations of reactants, relative reaction kinetics, the relative amount of lime present, and effective diffusivities of the gases within the powder mixture. These factors, together with the overall reaction kinetics, have yet to be determined.

The primary disadvantage of the hydrogen reduction process is the use of hydrogen which is relatively expensive (whereas many metal oxides can be reduced by relatively inexpensive coke), and the fact that the sulfide and lime mixture must be pelletized to accomodate the effective removel of hydrogen sulfide. This latter factor implies (1) an additional process step, pelletizing, (2) a potential heat transfer problem, and (3) a slower reaction rate due to diffusional effects.

Another study vaguely related to the foregoing involved chalcopyrite mixed with carbon and lime. The mixture was reacted with steam to produce calcium sulfide with carbon monoxide and hydrogen as gaseous intermediates. This study was directed toward producing calcium sulfide for subsequent use in generating hydrogen sulfide. No attention was given to the metal compounds from the chalcopyrite and no kinetic measurements were made. Additionally, since the maximum conversion in terms of sulfur fixed as calcium sulfide was 40–50% in the test, it would appear likely that only the iron constituent of the chalcopyrite was converted to the oxide while the copper constituent remained relatively unchanged.

Another process for recovering sulfur from iron pyrites is disclosed in U.S. Pat. No. 1,731,516 issued Oct. 15, 1929. In this process, steam reacts with iron pyrites in the presence of an alkali to produce hydrogen sulfide. Elemental sulfur can then be obtained by reacting the hydrogen sulfide with sulfur dioxide.

The direct reduction of copper sulfide ores with hydrogen is disclosed in U.S. Pat. No. 3,701,648 issued Oct. 31, 1972. Water vapor is included with the hydrogen to accelerate removal of hydrogen sulfide and to provide additional hydrogen.

U.S. Pat. No. 3,932,170 issued Jan. 13, 1976 discloses a process for the direct reduction of sulfide ores to metallic values using hydrogen and/or carbon monoxide in the presence of a scavenging agent such as calcium oxide.

The desulfurization of iron oxide pellets using an integral carbon is disclosed in U.S. Pat. No. 3,993,472 issued Nov. 23, 1976. The pelletizing of iron ore concentrates using binders such as either calcium oxide or calcium hydroxide is disclosed in U.S. Pat. No. 3,214,263 issued Oct. 26, 1965 and U.S. Pat. No. 4,093,448 issued June 6, 1978.

A process for leaching a low-grade molybdenite with water at an elevated temperature and pressure under an oxidizing atmosphere is disclosed in U.S. Pat. No. 3,714,325 issued Jan. 30, 1973.

In summary, many of the foregoing prior art processes use lime to remove sulfur-containing gases in the processing of metal sulfides. All require a continuous supply of reactant gases and the continuous withdrawal of product or waste gases. Accordingly, there is the problem of containment and recovery of sulfur-containing gases as experienced in the other prior art processes centered around the roasting concept. Furthermore, it is considered necessary to pelletize a intimate mixture of the metal sulfide and lime to facilitate removal of the sulfur-containing gases. Pelletizing, however, hinders diffision of the reactant gases and, therefore, hinders the rate of reaction. Pelletizing is believed also to contribute to the problem of temperature control since large temperature differences can occur inside the individual pellets with accompanying complications.

In view of the foregoing, it would be an advancement in the art to provide a process for converting the metal constituent of a metal sulfide ore to a metal oxide while using lime to capture the sulfur released from the reaction. Another advancement in the art would be to provide a process for removing sulfur from a sulfide-bearing ore using gaseous intermediates, water vapor and hydrogen sulfide, to transport oxygen and sulfur between the sulfide-bearing ore and lime in the absence of a net generation or consumption of gaseous species. It would also be an advancement in the art to provide a process for treating chalcopyrite to produce bornite. Another advancement in the art would be to provide a process whereby the process can proceed in a closed system thereby precluding escape of gaseous compounds of sulfur. Such a novel process is disclosed and claimed herein.

BRIEF SUMMARY AND OBJECTS OF THE INVENTION

The present invention relates to a novel process for removing sulfur from a sulfide-bearing ore. The ore is heated with lime in the presence of a limited quantity of water vapor. The water vapor reacts with the ore to produce hydrogen sulfide and the hydrogen sulfide reacts with the lime to regenerate the water vapor. The water vapor therefore serves as a carrier for oxygen between solids (lime to sulfide-bearing ore) while the hydrogen sulfide serves as a carrier for the sulfur between solids (sulfide-bearing ore to lime). Hydrogen sulfide is continuously produced but is also continuously reacted with the lime to continuously regenerate water vapor. As a result, there is no net consumption or production of gaseous species meaning that the overall reaction can be conducted in a closed system with respect to gaseous species. The process of this invention is particularly useful for treating sulfide-bearing ores of molybdenum, zinc, iron, mercury, nickel, and copper wherein the copper is present as chalcopyrite which is converted to bornite.

It is, therefore, a primary object of this invention to provide improvements in the process for removing sulfur from sulfide-bearing ores.

Another object of this invention is to provide a process for removing sulfur from sulfide-bearing ores in the absence of a net consumption and production of gaseous products.

Another object of this invention is to provide a process for obtaining a metal oxide from a sulfide-bearing ore while producing calcium sulfide, the process taking place in the presence of water vapor and lime and in a closed system as far as gaseous species are concerned.

Another object of this invention is to provide a process for removing sulfur from a sulfide-bearing ore by reacting water vapor with the sulfide-bearing ore to produce hydrogen sulfide and reacting the hydrogen sulfide with lime to regenerate the water vapor, the process thereby proceeding in the absence of a net consumption or production of gaseous species.

Another object of this invention is to provide a process for removing sulfur from sulfide-bearing ores in a closed system with respect to gaseous species while accomodating the continuous flow of solids.

Another object of this invention is to provide a process for treating sulfide-bearing ores of molybdenum, zinc, iron, mercury, and nickel to produce an oxide of the respective metal.

Another object of this invention is to provide a process for treating chalcopyrite to produce bornite and magnetite.

These and other objects and features of the present invention will become more fully apparent from the following description and appended claims taken in conjunction with the accompanying drawing.

DETAILED DESCRIPTION OF THE PREFERRED EMBODIMENTS

Figure 1:
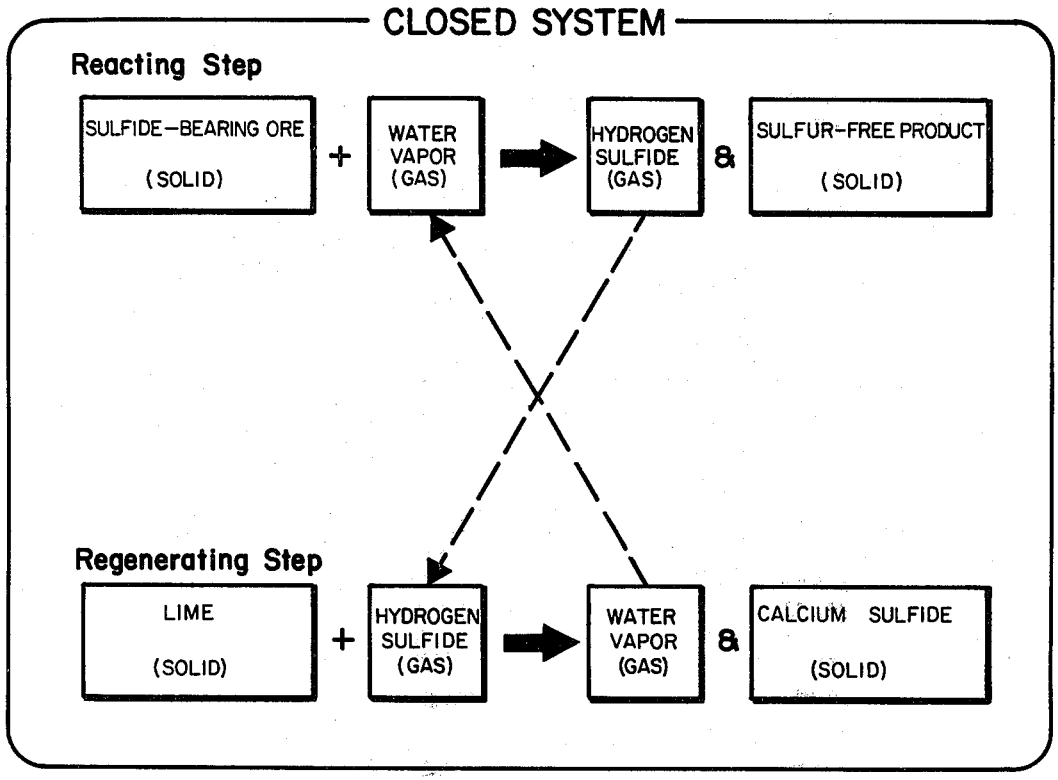
FIG. 1 is a schematic representation of the novel process of this invention and, more particularly, of the pair of gas-solid reactions that occur therein.

The invention is best understood by reference to the drawing in combination with the detailed description hereinafter.

General Discussion

Sulfide-bearing minerals or ores are important sources of many metals. To extract metals from the ores, the sulfide is usually roasted into oxides prior to further treatment for the recovery of the metal values from the oxides. However, as set forth hereinbefore, the roasting process generates gaseous oxides of sulfur, usually sulfur dioxide, with a corresponding creation of a substantial environmental problem of containment and recovery.

The object of the research which resulted in the present invention was to determine the technical feasibility, including the reaction kinetics, of a novel process for obtaining desirable metal values from sulfide-bearing ores without the net generation of sulfur-containing gases. The reaction of the present invention is based upon the following chemistry:

$$Me_xS + H_2O = Me_xO + H_2S \quad (4)$$

$$H_2S + CaO = H_2O + CaS \quad (5)$$

The overall reaction equation is as follows:

$$Me_xS + CaO = Me_xO + CaS \quad (6)$$

where $Me_xS$ is a simplified representation of metal sulfides in general of the metal (Me).

Clearly, there have been other schemes for using lime in the treatment of sulfide ores as has been set forth hereinbefore, but the chemistry disclosed herein is completely novel. Unlike other processes, no gaseous reactants are required except for a small amount of steam or water initially charged to the reactor. Surprisingly, there is no net consumption or production of gaseous species so that the reaction is readily adaptable for a closed system as far as gaseous species are concerned. In all the processes currently practiced or proposed by others, a continuous supply of gaseous reactants, such as steam, oxygen, or hydrogen, is required. Advantageously, the novel process of this invention (a) precludes the emission of sulfur-containing gases and (b) eliminates the requirement for a continuous supply of gaseous reactants, thus removing the costs associated with both of these features. Importantly also, the novel process of this invention eliminates the resistance to diffusion because the gaseous reactant and product, water vapor ($H_2O$, see FIG. 1 and Equations (4) and (5)) is regenerated in close proximity to the sulfide-bearing ore.

The production of calcium sulfide is advantageous since calcium sulfide can be used subsequently to generate hydrogen sulfide in high concentration by treating the calcium sulfide with water and carbon dioxide or other suitable acids. The hydrogen sulfide thus produced can be reacted with air according to a well-known process to produce elemental sulfur. Importantly, it should be noted that the capture of sulfur as calcium sulfate, according to some of the prior art processes, does not lend itself to the recovery of elemental sulfur.

The reaction scheme disclosed herein (FIG. 1 and equations (4) and (5)), involves a pair of gas-solid reactions or, more particularly, the reaction between two solids (the sulfide-bearing ore and lime) proceeding through the gaseous intermediates, water vapor and hydrogen sulfide. It is of particular interest to note the difference between the foregoing reactions and the carbothermal reduction of metal oxides. In the latter, the gaseous intermediates are generated continuously during the reaction. However, in the process of the present invention, there is no net change of gaseous intermediates so that the overall reaction can be said to be "catalyzed" by the gaseous intermediates. While the reaction kinetics of the process of this invention are not completely understood, the experimental results obtained to date bear out the foregoing conclusion.

Water vapor and hydrogen sulfide act as carriers of oxygen and sulfur, respectively, so that while the water vapor and hydrogen sulfide do not appear in the overall reaction equation, (Equation 6) they are expected to play an important role in speeding the rate of reaction by replacing the true solid-solid reaction (see Example 2) with a pair of gas-solid reactions (FIG. 1). Gas-solid reactions are generally much faster than true solid-solid reactions.

Furthermore, since hydrogen sulfide is not carried out of the system, a fluidized bed reactor can be used wherein a mixture of the sulfide-bearing ore and lime are reacted with the gas being circulated in a closed loop simply to maintain fluidization of the fluidized bed until the reaction is completed. Additionally, a packed bed charged with pellets of sulfide-bearing ores coated with the lime may also be used for carrying out the process of the invention. Accordingly, with a proper design, either of the foregoing processes can be carried out in a continuous flow process as far as solids are concerned while maintaining the system as a closed system as far as gaseous species are concerned.

The thermodynamics for the Reacting Step (FIG. 1) reaction of Equation (4) proceeding to the right is generally quite unfavorable due to the positive free energy change of the reaction. The reaction, therefore, does not proceed very far unless the gaseous product, hydrogen sulfide, is continuously removed from the gas phase. It is well-known that calcium oxide reacts readily with hydrogen sulfide even at low concentrations according to the Regeneration Step (FIG. 1) reaction of Equation (5). The large negative free energy change of the reaction of Equation (5) makes the free energy change of the overall reaction of Equation (6) negative for certain metal sulfides. Metal sulfides of industrial importance, the transformation to oxides of which, according to their reaction of Equation (6), is thermodynamically favorable, includes sulfides of molybdenum, iron, zinc, and mercury. The free energy changes of the reactions for certain of these sulfides according to the reaction of Equation (6) at 1,000° K. are listed in Table I below:

TABLE I

FREE ENERGY CHANGES FOR REACTIONS OF SULFIDES WITH LIME AT 1000° K.

| Sulfide | F(cal/g-mole) |
|---|---|
| Molybdenum Sulfide ($MoS_2$) | −14,200 |
| Iron Sulfide (FeS) | −3,000 |

TABLE I-continued

| FREE ENERGY CHANGES FOR REACTIONS OF SULFIDES WITH LIME AT 1000° K. | |
|---|---|
| Sulfide | F(cal/g-mole) |
| Zinc Sulfide (ZnS) | −1,000 |

The proposed reaction scheme of the present invention provides numerous advantages over the prior art process of roasting since there is no yet consumption or generation of gaseous species. Accordingly, gaseous reactants need not be supplied continuously and the emission of sulfur-containing gases can be completely eliminated. The process can, therefore, be carried out in a closed system as far as gaseous species are concerned.

Advantageously, the process of the present invention (1) does not require a continuous supply of gaseous reactants, (2) does not cause emission of sulfur-containing, gaseous pollutants, (3) does not require that the reactant powders be pelletized, (4) avoids generation of excessively high temperatures, and (5) fixes the sulfur so that it can be readily recovered by further treatment of the calcium sulfide product. The absence of a requirement for a continuous supply of gaseous reactants represents a substantial savings over the existing processes. For example, the energy requirements will be substantially lower since there is no flow of gas that must be heated to the reaction temperature. In fact, the overall reaction is moderately exothermic so that the low energy requirement of the process of this invention is an important factor. As one additional note, the production of calcium molybdate, which takes place when molybdenum sulfide and lime are in contact, as shown in Example 3, below, can be provided with a continuous supply of steam. A valuable product, hydrogen, is obtained as a result of the reaction and any residual steam can be readily separated by condensation from the hydrogen product.

The elimination of the emission of sulfur-containing gases is made possible by two factors (1) the lime serves as a scavenger for hydrogen sulfide and (2) there are no other gaseous products that could carry sulfur-containing gases out of the system. However, again in the case of calcium molybdate production, the hydrogen produced must be removed continuously from the system. It has been shown, however, that most of the hydrogen sulfide involved in the reaction can be captured with the lime if the mixture is suitably pelletized. While the reactant solids need not be pelletized if a fluidized bed is incorporated into the process, pelletizing may still be preferred if handling any fine particles produces difficulties. However, pelletizing need not diminish the other advantages listed for this process.

The principal ore of molybdenum is molybdenite (molybdenum disulfide, $MoS_2$). One of the ores of zinc is zinc blende (zinc sulfide, ZnS). Although iron is generally found as oxides, iron is also found combined with sulfur as iron pyrites (iron sulfide, $FeS_2$). While ferrous sulfide is rare in nature, iron pyrites is very common but is usually not worked directly for iron on account of the difficulty involved in eliminating the sulfur from the product with the result that iron pyrites is customarily regarded as a sulfur ore. Pentlandite, $(FeNi)_9S_8$, is the most important ore of nickel. Copper is usually found as sulfides in fairly complex minerals, for example, in combination with iron as chalcopyrite.

Mercury is chiefly found as a sulfide in cinnabar (mercury sulfide, HgS) and the overall reaction of this invention proceeds further from the reaction of Equation (6) due to the instability of mercury oxide. The overall reaction, therefore, becomes:

$$4HgS+4CaO=4Hg+3CaS+CaSO_4 \quad (7)$$

The mercury, as a vapor, can be removed continuously. Although the direct reaction of mercury sulfide and calcium oxide is possible, the scheme of the present invention includes water vapor, since water vapor is expected to greatly enhance the reaction rate.

Pentlandite, $((FeNi)_9S_8)$, may also be oxidized through this reaction. Other sulfides with only slightly positive free energy change of reaction (on the order of 5,000 cal/g-mole) include those of nickel, and cobalt as well as chalcopyrite. These sulfide-bearing ores may be amendable to such oxidation schemes with some modification to lower the partial pressure of hydrogen sulfide by removing it continuously from the gas phase.

With particular reference to FIG. 1, a schematic representation of the novel process of this invention is set forth to illustrate the reaction steps of this invention. The process includes forming a reaction mixture by mixing lime with sulfide-bearing ore prior to charging a closed system such as a reactor with the reaction mixture. An initial charge of water is also added to the reactor. The reactor may be considered as a closed system as far as gaseous species are concerned since there is no net consumption or production of gaseous species relative to the reactor. Clearly, the reaction itself results in the production of gaseous species, hydrogen sulfide and water vapor, as shown by Equation (4) and Equation (5). However, the same amounts of these gaseous species are consumed as shown by Equation (5) and Equation (4), respectively, and thus they merely serve in the capacity of carriers for oxygen and sulfur so that there is no net production of gaseous species, Equation (6). Accordingly, the reactor constitutes a closed system in terms of gases. A closed loop fluidizing system can be used to provide a fluidized bed for the reactants, if desired, and solids can be processed continuously through the reactor.

The following nonrestrictive examples are set forth herein to further demonstrate the novel process of this invention. In all experimental examples a stoichiometric or greater amount of lime was included with the sulfide-bearing ore to provide the necessary oxygen for the reaction and to react with the sulfur thus removed.

EXAMPLE 1

Molybdenite and calcium oxide were reacted under one atmosphere pressure of steam at various temperatures between 600° C. and 940° C. Molybdenite was pressed into thin, porous discs separated from lime products by a very thin, porous layer of alumina fiber. The alumina fiber prevented the solids from touching each other and forming calcium molybdate. The reaction took place in a closed, Inconnel reactor. The reactor was initially charged with the solids (placed on a platinum tray) and with steam, then closed and its temperature raised to the desired value as quickly as possible. Results of some rate measurements are shown in FIG. 2.

Analysis of the percentage of conversion of the reactants was determined by separately weighing the solids both before and after the reaction. The reaction products were verified by X-ray diffraction measurements. It was observed in these experiments that an equal weight change of molybdenite and lime was obtained as required by the overall reaction of Equation (6). X-ray diffraction measurements also revealed only molybdenum dioxide on the molybdenite pellet and only calcium sulfide on the lime pellet, which positively confirmed the reaction scheme predicted by the reactions of Equations (4) and (5).

Figure 2:
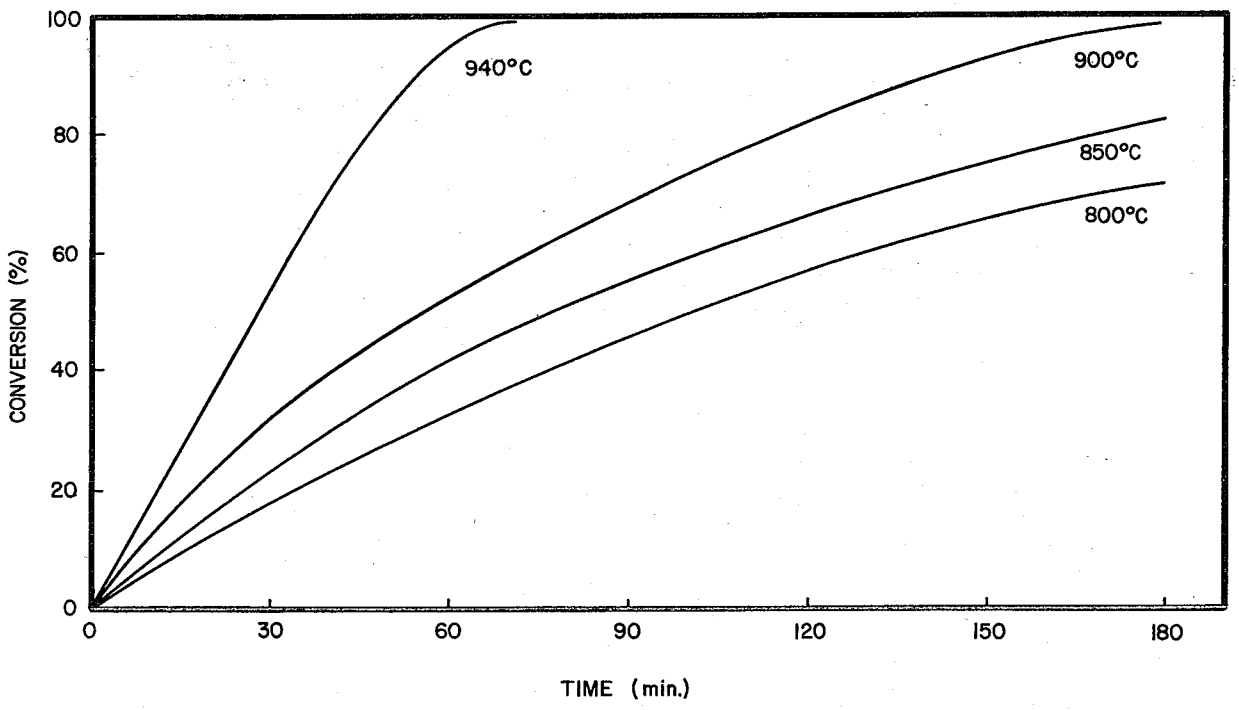
FIG. 2 is a graph representing the percentage conversion of molybdenum sulfide to molybdenum dioxide as a function of time at different reaction temperatures and a steam partial pressure of 0.85 atmosphere according to the process of this invention.

With particular reference to FIG. 2, the rate of reaction was fairly substantial at temperatures above about 800° C. At 940° C., conversion was almost complete within one hour. It should be noted that experimental runs at 600° C.–750° C. were rather erratic and the rate was in general quite slow so that the results were thus not illustrated in FIG. 2.

The primary purpose of these experiments was to verify that the reaction occurred as postulated. To simplify the experimental procedure, thin pellets were used, and it is, therefore, conceivable that some diffusional effects may have been present with a resultant slowing down of the reaction rate. It is possible that the rate of the reaction can be increased if the calcium oxide/molybdenum sulfide ratio is increased.

EXAMPLE 2

In order to determine further the rate of the true solid-solid reaction represented by the reaction of Equation (6), fine particles of molybdenite and lime were uniformly mixed and heated to 950° C. under nitrogen for several hours. Importantly, no measureable amounts of molybdenum dioxide or calcium sulfide were formed clearly demonstrating that the reaction of Equation (6) proceeds through the pair of gas-solid reactions of Equation (4) and Equation (5). Thus, the contribution of the true solid-solid reaction between molybdenite and lime in the absence of the intermediate gases, steam and hydrogen sulfide, have been determined to be insignificant at the temperature ranges studied.

EXAMPLE 3

Surprisingly, it was discovered that when a mixture of fine powders of molybdenite and lime were reacted with extra steam, calcium molybdate and hydrogen were formed. The reaction of a mixture of molybdenum sulfide and lime proceeds as follows:

$$MoS_2+2H_2O=MoO_2+2H_2S \quad (8)$$

$$CaO+H_2S=CaS+H_2O \quad (9)$$

so that when molybdenum sulfide and lime are intimately mixed, the following reaction occurs:

$$MoO_2+CaO+H_2O=CaMoO_4+H_2 \quad (10)$$

Thus, the reaction of Equation (10) produces a very useful product, calcium molybdate, which is used as an alloying agent in steelmaking, and it also produces a useful byproduct, hydrogen.

It is currently believed that this reaction has never been disclosed until the present. As noted earlier, this reaction is important in that a molybdenum compound (without sulfur) is produced together with a valuable byproduct (hydrogen). Thus, the process for producing calcium molybdate through the reaction of Equation (10) is also a significant advancement in the art.

EXAMPLE 4

Preliminary studies on the removal of sulfur from chalcopyrite to produce bornite, magnetite and calcium sulfide indicate that the reactions are as follows:

$$15CuFeS_2+16H_2O=3Cu_5FeS_4+4Fe_3O_4+16H_2S+2S \quad (11)$$

$$16CaO+16H_2S=16CaS+16H_2O \quad (12)$$

with an overall reaction:

$$15CuFeS_2+16CaO=3Cu_5FeS_4+4Fe_3O_4+16CaS+2S \quad (13)$$

Chalcopyrite, 0.05 g, was surrounded by an excess of fine particles of lime and reacted in the presence of a limited quantity of steam in a closed reactor. At 800° C., 80% conversion was attained in 36 minutes and 90% in 69 minutes. At 840° C., 80% conversion was attained in 68 minutes and 90% in 122 minutes.

Although copper does not become an oxide in this case, magnetite formed by this reaction can easily be separated by mechanical means. Furthermore, bornite can be much more easily treated than chalcopyrite to produce copper by hydrometallurgical or pyrometallurgical processes primarily because it contains much less sulfur for the same amount of copper.

EXAMPLE 5

A small quantity (0.05 g) of fine particles of zinc sulfide (ZnS) surrounded by an excess of fine particles of lime was reacted in the presence of a limited quantity of steam in a closed reactor. At 860° C., 80% conversion of ZnS to ZnO was achieved in 45 minutes and 90% in 67 minutes. At 840° C., 70% conversion was reached in 57 minutes and 82% conversion in 120 minutes.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A process for removing sulfur from a sulfide-bearing ore comprising the steps of:

mixing lime with the sulfide-bearing ore;

adding water to said mixture;

heating the mixture such that water vapor reacts with the sulfide-bearing ore to form hydrogen sulfide gas, thereby substantially removing the sulfur from said ore; and reacting the hydrogen sulfide gas with the lime to form calcium sulfide and water vapor so that substantially all of the sulfur is removed from a gaseous form, said water vapor being capable of reacting with the sulfide-bearing ore and separating the ore from the calcium sulfide.

2. A process as defined in claim 1 wherein the heating step is accomplished by introducing steam to the mixture of lime and sulfide-bearing ore, the steam further providing said water to the mixture.

3. A process as defined in claim 1 wherein the sulfide-bearing ore is an ore bearing metals selected from the group consisting of molybdenum, zinc, iron, mercury, nickel, and copper.

4. A process as defined in claim 1 wherein the reaction is conducted in a closed system such that there is no substantial net consumption or generation of gaseous products.

5. A process as defined in claim 1 wherein the reaction mixture is heated to a temperature within the range of between about 600° C. and the lower melting temperature of solid components of the reaction mixture.

6. A process as defined in claim 1 wherein the reaction is conducted under a pressure greater than atmospheric.

7. A process for removing sulfur from an ore from the group consisting of chalcopyrite and producing bornite comprising the steps of:

mixing lime with chalcopyrite;

adding water to said mixture;

heating the mixture such that water vapor reacts with the chalcopyrite to form hydrogen sulfide gas, thereby substantially removing the sulfur from the chalcopyrite; and reacting the hydrogen sulfide gas with the lime to form calcium sulfide and water vapor so that substantially all of the sulfur is removed from a gaseous form, said water vapor being capable of reacting with the chalcopyrite and separating the ore from the calcium sulfide.

8. A process as defined in claim 7 wherein the heating step is accomplished by introducing steam to the mixture of lime and chalcopyrite, the steam further providing said water to the mixture.

9. A process as defined in claim 7 wherein the reaction is conducted in a closed system such that there is no substantial net consumption or generation of gaseous products.

10. A process as defined in claim 7 wherein the reaction mixture is heated to a temperature within the range of between about 600° C. and the lower melting temperature of said components of the reaction mixture.

11. A process for removing sulfur from an ore comprising molybdenum sulfide comprising the steps of:

mixing lime with molybdenum sulfide;

adding water to said mixture;

heating the mixture such that water vapor reacts with the molybdenum sulfide to form molybdenum oxide and hydrogen sulfide; and reacting the hydrogen sulfide with the lime to form calcium sulfide and water so that substantially all of the sulfur is removed from a gaseous form, said water being capable of reacting with the molybdenum sulfide and separating the ore from the calcium sulfide.

12. A process as defined in claim 11 further comprising the step of reacting the molybdenum oxide with lime and water vapor to produce calcium molybdate and hydrogen.

* * * * *

UNITED STATES PATENT AND TRADEMARK OFFICE

CERTIFICATE OF CORRECTION

PATENT NO. : 4,376,647

DATED : March 15, 1983

INVENTOR(S) : Hong Y. Sohn

It is certified that error appears in the above-identified patent and that said Letters Patent are hereby corrected as shown below:

Column 1, line 3, should read: -- ORES -- centered in the column.

Column 1, before line 5: the heading -- RELATED APPLICATIONS -- should be inserted, centered in the column, with a blank line preceding and following the heading.

Column 3, line 46: "a intimate" should read -- an intimate --.

Column 3, line 49: "diffision" should read -- diffusion --.

Column 5, line 9: "General Discussion" should be set off from the body of the text with a blank line preceding and following the heading.

Column 10, equation 11: the compound "$-4Fe_3O_4$" should not be split onto two lines.

Column 10, equation 13: the compound "16CaS" should not be split onto two lines.

UNITED STATES PATENT AND TRADEMARK OFFICE

CERTIFICATE OF CORRECTION

PATENT NO. : 4,376,647

DATED : March 15,1983

INVENTOR(S) : Hong Y. Sohn

It is certified that error appears in the above–identified patent and that said Letters Patent are hereby corrected as shown below:

Column 10, line 53: should read -- mixing lime in a separator with the sulfide-bearing ore;--.

Column 11, line 19: should read -- mixing lime in a separator with chalcopyrite;--.

Column 12, line 15: should read -- mixing lime in a separator with molybdenum sulfide; --.

Signed and Sealed this

*Second* Day of *August 1983*

[SEAL]

*Attest:*

GERALD J. MOSSINGHOFF

*Attesting Officer* *Commissioner of Patents and Trademarks*

UNITED STATES PATENT AND TRADEMARK OFFICE

CERTIFICATE OF CORRECTION

PATENT NO. : 4,376,647
DATED : March 15, 1983
INVENTOR(S) : Hong Y. Sohn

It is certified that error appears in the above—identified patent and that said Letters Patent is hereby corrected as shown below:

Column 1, between lines 16 and 17; please insert the following:

-- 2. Governmental Rights

The Government has rights in this invention pursuant to grant ENG-75-13085 awarded by the National Science Foundation. --

Column 1, line 17; please change the numeral "2" to the numeral -- 3 --.

Column 2, line 59; please change "accomodate" to -- accommodate --.

Column 7, lines 59 and 63; please change "pyrites is" to -- pyrites are --.

Signed and Sealed this

*Eighth* Day of *November 1983*

[SEAL]

*Attest:*

GERALD J. MOSSINGHOFF

*Attesting Officer*

*Commissioner of Patents and Trademarks*